US006619511B2

(12) United States Patent
Hydak et al.

(10) Patent No.: US 6,619,511 B2
(45) Date of Patent: Sep. 16, 2003

(54) FEED TUBE ADAPTER FOR A BOTTLED WATER COOLER

(75) Inventors: Kenneth J. Hydak, Worthington, OH (US); Declan Laurence Coyle, Ballina (IE); Stephen John Sabin, Ballina (IE); Louis M. Busick, Columbus, OH (US)

(73) Assignee: Oasis Corporation, Columbus, OH (US)

( * ) Notice: Subject to any disclaimer, the term of this patent is extended or adjusted under 35 U.S.C. 154(b) by 0 days.

(21) Appl. No.: 10/071,009

(22) Filed: Feb. 7, 2002

(65) Prior Publication Data

US 2002/0129869 A1 Sep. 19, 2002

Related U.S. Application Data

(60) Provisional application No. 60/268,381, filed on Feb. 8, 2001.

(51) Int. Cl.[7] ..... B67D 5/06

(52) U.S. Cl. ..... 222/185.1; 222/146.6; 222/325; 141/18; 141/352; 141/364; 141/375; 62/389

(58) Field of Search ..... 141/350–354, 141/18, 82, 363–366, 375; 222/146.6, 185.1, 325; 62/389, 391

(56) References Cited

U.S. PATENT DOCUMENTS

| | | | |
|---|---|---|---|
| 32,354 | A | 5/1861 | Cornelius |
| 738,712 | A | 9/1903 | Cole |
| 996,127 | A | 6/1911 | Patnaude |
| 1,018,924 | A | 2/1912 | Patnaude |
| 1,142,210 | A | 6/1915 | Wagner |
| 1,228,836 | A | 6/1917 | Schulse |
| 1,241,352 | A | 9/1917 | Doering, Jr. et al. |
| 1,248,705 | A | 12/1917 | Pogue |
| 1,319,376 | A | 10/1919 | Cooper |
| 1,337,206 | A | 4/1920 | Doering et al. |
| 1,933,192 | A | 10/1933 | Taylor |
| 2,057,238 | A | 10/1936 | Krug |
| 2,072,629 | A | 3/1937 | Fernholz |
| 2,689,669 | A | 9/1954 | Ericson |
| 3,892,235 | A | 7/1975 | Van Amerorgen et al. |
| 3,966,093 | A | 6/1976 | Frahm et al. |
| 3,974,863 | A | 8/1976 | Frahm et al. |
| D248,440 | S | 7/1978 | Bryan et al. |
| 4,356,848 | A | 11/1982 | Spies |
| D268,394 | S | 3/1983 | MacEwen |
| 4,421,146 | A | 12/1983 | Bond et al. |
| 4,444,340 | A | 4/1984 | Bond et al. |
| 4,445,551 | A | 5/1984 | Bond et al. |
| 4,597,423 | A | 7/1986 | Chenot |
| 4,699,188 | A | 10/1987 | Baker et al. |
| 4,793,514 | A | 12/1988 | Sheets |
| 4,834,267 | A | 5/1989 | Schroer et al. |
| 4,846,236 | A | 7/1989 | Deruntz |
| 4,874,023 | A | 10/1989 | Ulm |

(List continued on next page.)

*Primary Examiner*—J. Casimer Jacyna
(74) *Attorney, Agent, or Firm*—Kelly Bauersfeld Lowry & Kelley, LLP

(57) ABSTRACT

An improved mounting adapter is provided for use in a bottled water cooler of the type having an upwardly open cooler reservoir for receiving a supply of water from a bottle mounted over the reservoir in an inverted orientation to permit water downflow from the bottle to the reservoir. The improved adapter includes a compact and substantially unitized adapter body or shell for removable snap-fit mounting onto the cooler reservoir at the open upper end thereof. The adapter additionally includes an upstanding feed tube or probe for operatively engaging a valved bottle cap mounted on the neck of a water-containing bottle supported in an inverted orientation over the cooler reservoir. In one form, the adapter may carry a seal ring gasket for sealingly engaging an inner wall surface of the cooler reservoir, and an air filter may be provided to filter ambient air drawn into the reservoir.

52 Claims, 8 Drawing Sheets

U.S. PATENT DOCUMENTS

| | | | |
|---|---|---|---|
| 4,902,320 | A | 2/1990 | Schroer et al. |
| 4,972,976 | A | 11/1990 | Romero |
| 5,031,676 | A | 7/1991 | Ulm |
| 5,121,778 | A | 6/1992 | Baker et al. |
| D331,349 | S | 12/1992 | Culverson |
| 5,213,309 | A | 5/1993 | Makishima |
| 5,222,530 | A | 6/1993 | Baker et al. |
| 5,222,531 | A | 6/1993 | Baker et al. |
| 5,259,534 | A | 11/1993 | Lynd |
| 5,273,083 | A | 12/1993 | Burrows |
| 5,289,854 | A | 3/1994 | Baker et al. |
| 5,289,855 | A | 3/1994 | Baker et al. |
| 5,295,518 | A | 3/1994 | Baker et al. |
| 5,295,519 | A | 3/1994 | Baker et al. |
| 5,337,922 | A | 8/1994 | Salkeld et al. |
| 5,395,590 | A | 3/1995 | Swaniger et al. |
| 5,413,152 | A | 5/1995 | Burrows |
| 5,431,205 | A | 7/1995 | Gebhard |
| 5,454,409 | A | 10/1995 | McAffer et al. |
| 5,464,127 | A | 11/1995 | Burrows |
| D366,391 | S | 1/1996 | Haley et al. |
| D369,942 | S | 5/1996 | Ahern, Jr. |
| 5,526,961 | A | 6/1996 | Burrows |
| 5,647,416 | A | 7/1997 | Desrosiers et al. |
| 5,653,270 | A | 8/1997 | Burrows |
| 5,676,278 | A | 10/1997 | Beyer et al. |
| 5,711,380 | A | 1/1998 | Chen |
| 6,029,860 | A | 2/2000 | Donselman et al. |
| D426,746 | S | 6/2000 | Busick et al. |
| D429,111 | S | 8/2000 | Busick et al. |
| 6,167,921 | B1 | 1/2001 | Busick et al.- |

FEED TUBE ADAPTER FOR A BOTTLED WATER COOLER

This application claims the benefit of Provisional Application No. 60/268,381, filed Feb. 8, 2001.

BACKGROUND OF THE INVENTION

This invention relates generally to improvements in mounting adapters of the type for use in a bottled water cooler, and including a feed tube or probe for operating a valved bottle cap carried on the neck of a water-containing bottle to open the bottle cap incident to bottle mounting in an inverted orientation onto the water cooler so that water can flow downwardly from the bottle into a cooler reservoir. More particularly, this invention relates to an improved mounting adapter constructed from a relative minimum number of component parts, and wherein the adapter is designed for fast and simple snap-fit installation into and/or removal from the reservoir of a water cooler.

Bottled water coolers are generally known in the art to comprise a cooler housing supporting an upwardly open reservoir to receive a supply of water for on-demand dispensing via one or more faucet valves or the like. The cooler housing and/or the reservoir are designed to support a water bottle of typically three to five gallon capacity in an inverted orientation over the reservoir, so that water contained within the bottle may flow downwardly into and fill the reservoir to a level sufficient to cover an open bottle mouth formed in a bottle neck. In this regard, downward water flow from the bottle is accompanied by an upward exchange of air passing from the reservoir into the bottle to replace the volume of water displaced or discharged from the bottle. This air-water exchange between the overlying bottle and the underlying reservoir continues until the reservoir water level rises sufficiently to cover the bottle mouth, at which time upward air exchange is halted to correspondingly stop downward waterflow. Subsequent dispensing of water from the reservoir by operation of the faucet valves causes the water level within the reservoir to fall below and thus uncover the bottle mouth, whereupon the air-water exchange may resume to enable additional water to flow downwardly from the bottle to refill the reservoir. In many modern bottled water coolers of this general type, the reservoir may be associated with refrigeration means for chilling at least a portion of the water contained therein to provide chilled water used primarily for drinking or for use in making chilled beverages.

In the past, it has been conventional to provide the water bottle to a customer in a substantially filled state with the bottle mouth closed and sealed by a bottle cap. This bottle cap normally includes a tear-away skirt to allow the customer to remove the cap immediately prior to installation of the bottle in an inverted orientation on the cooler. More recently, alternative valved bottle caps have been designed to remain on the water bottle when the bottle is installed onto the cooler, wherein such alternative bottle caps are designed to be engaged and opened by a feed tube or probe mounted on the cooler in a position over the reservoir. See, for example, U.S. Pat. Nos. 4,874,023; 5,222,531; 5,232,125; 5,413,152 and 6,167,921. In these arrangements, the feed tube or probe is provided as a portion of a mounting adapter installed onto the cooler to extend over and substantially cover the top of the reservoir to reduce or prevent entry of dirt and other contaminants. The feed tube or probe has a contoured head or tip for engaging a valve plug on the bottle cap to open a flow path as an incident to bottle installation, thereby permitting bottle installation onto the cooler with little or no water spillage. The feed tube or probe may further be designed to return the valve plug to a closed position on the cap as the bottle is removed from the cooler.

Feed tube adapters of this general type are normally equipped with a seal ring gasket or the like for sealingly engaging the reservoir, and an air filter is mounted on the adapter to filter air drawn into the cooler reservoir along an entry flow path. With this construction, the water within the reservoir is protected against contact with airborne particulate and contaminants which may be present in ambient air. In many adapter designs, the seal ring gasket is carried about the exterior of the mounting adapter and is sized to bindingly engage an interior wall segment of the cooler reservoir with a sufficient engagement force whereby the gasket additionally performs the function of retaining the adapter in position on the reservoir during normal use. In some applications, however, it is desirable to provide the mounting adapter without the air filter for filtering air drawn into the cooler reservoir. In such nonfiltered applications, it has generally been necessary to retain the seal ring gasket for frictionally retaining the adapter on the cooler reservoir during normal use.

The present invention provides an improved and simplified construction for a feed tube mounting adapter, wherein the adapter and the associated cooler reservoir include snap-fit mounting means for quickly, easily and removably mounting the adapter onto the reservoir in a secure and stable manner. Beneficially, the improved mounting adapter may be utilized in alternative configurations including or excluding the seal ring gasket and associated air filter.

SUMMARY OF THE INVENTION

In accordance with the invention, an improved mounting adapter is provided for use in a bottled water cooler of the type having an upwardly open cooler reservoir for receiving a supply of water from a bottle mounted over the reservoir in an inverted orientation to permit water downflow from the bottle to the reservoir. The improved adapter includes a compact and substantially unitized adapter body or shell constructed from a minimum number of component parts and adapted for removable snap-fit mounting onto the cooler reservoir at the open upper end thereof. The adapter additionally includes an upstanding feed tube or probe for operatively engaging a valved bottle cap mounted on the neck of a water-containing bottle supported in an inverted orientation over the cooler reservoir.

In the preferred form of the invention, the adapter body is constructed from molded plastic or the like as a unitary or substantially unitary component to include an upper cylindrical sleeve segment defining a short radially outwardly projecting support rim at the upper end thereof for seating onto a matingly shaped support ledge formed at the upper end of the cooler reservoir. A lower margin of this upper sleeve segment is joined to a radially inwardly extending annular landing, which is in turn joined at an inner margin thereof to a suspended central cup or well having a bottom wall. A tubular central post upstands from this bottom wall and terminates at an upper tip end disposed at or a short distance above the annular landing. A feed tube insert provided as a separately molded component is mounted as by a snap-fit connection within the central post and cooperates therewith to define the feed tube having separate flow passages for air and water. An upper end tip or head of the feed tube insert is contoured for operatively engaging a valved bottle cap, as shown and described in U.S. Pat. No. 5,413,152, which is incorporated by reference herein.

The upper support rim on the mounting adapter carries snap-fit mounting means for removably and securely mounting the adapter onto the upper end of the cooler reservoir. In a preferred form, the snap-fit mounting means comprises outwardly projecting detent pins formed at generally diametrically opposed positions on the support rim. At one side of the adapter, the detent pins may be carried by a spring tab projecting upwardly from the annular landing and separated from the remainder of the cylindrical sleeve segment by a pair of vertically extending slots. The detent pins on the adapter are positioned for snap-fit engagement into matingly sized and positioned detent ports formed in an upwardly projecting reservoir flange which circumscribes the support ledge at the upper end of the cooler reservoir.

In normal operation, the detent pins securely support and retain the mounting adapter on the reservoir, without undesired displacement in response to installation and/or removal of water bottles therefrom. In one configuration, the adapter may be equipped with a seal ring gasket mounted about the exterior of the upper sleeve segment for sealingly engaging an interior wall surface of the reservoir when the adapted is installed therein. In this version, an air inflow port is equipped with an air filter unit for filtering ambient air drawn into the cooler reservoir. In another configuration, the adapter may be used without the seal ring gasket, in which case the air flow port is desirably occluded but not sealed with a plug designed to prevent entry of debris into the cooler reservoir.

In either configuration, the mounting adapter is installed quickly and easily into the cooler reservoir by simple drop-in placement with the detent pins snap-fitted into the aligned detent ports formed in the reservoir. The adapter can be removed from the reservoir quickly and easily for cleaning or other maintenance procedures by pressing radially inwardly on the spring tab sufficiently to release the associated detent pins from the reservoir detent ports. In a similar manner, the feed tube insert can be removed quickly and easily from the tubular central post on the adapter body for facilitated cleaning.

Other features and advantages of the invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
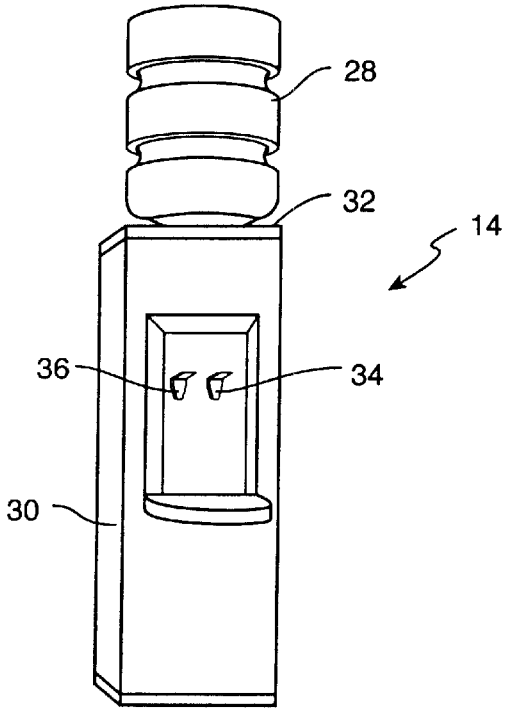
FIG. 1 is a front perspective view illustrating a bottled water cooler adapter for use with a mounting adapter embodying the novel features of the invention.
Figure 2:
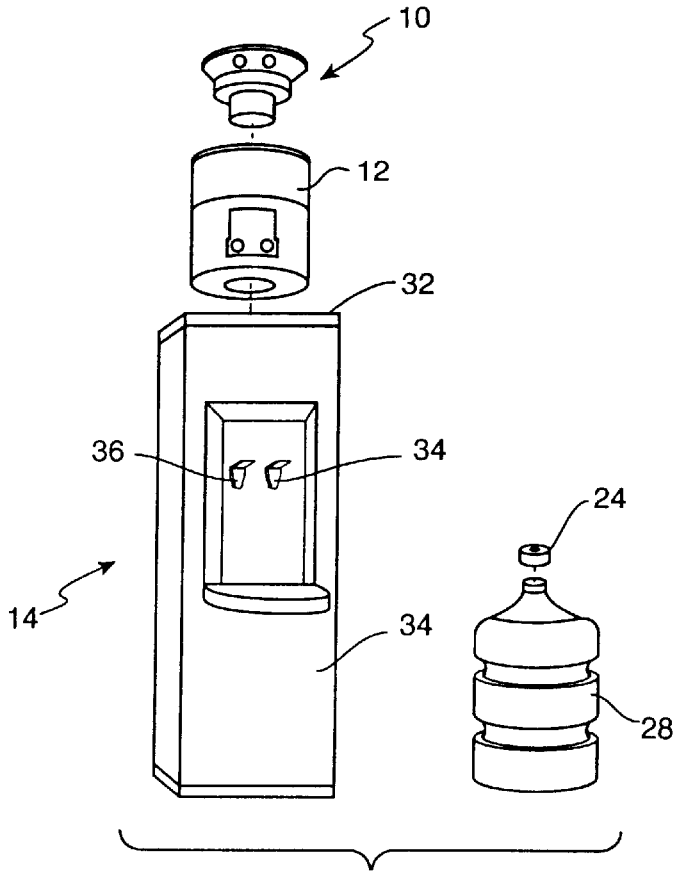
FIG. 2 is an exploded perspective view showing the mounting adapter and a removable water-containing reservoir in exploded relation to a water cooler cabinet, and further depicting a water bottle in combination with a valved bottle cap.
Figure 11:
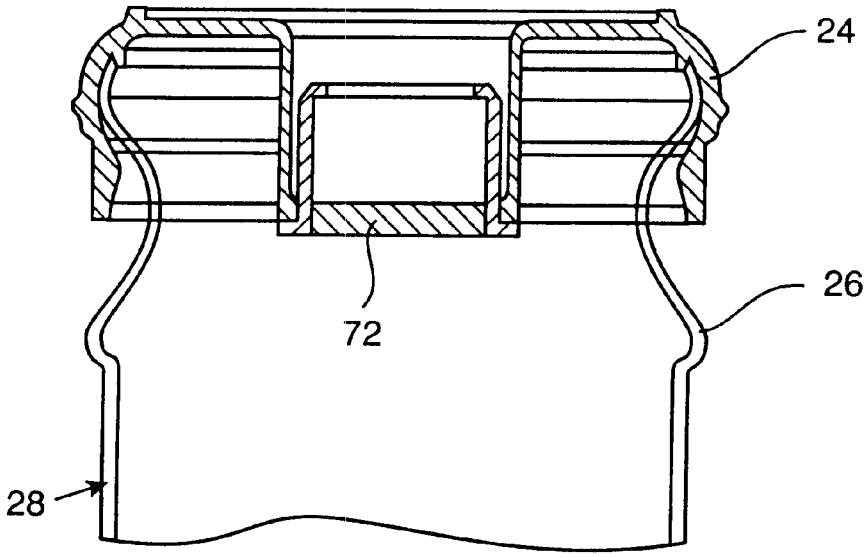
FIG. 11 is a vertical sectional view depicting the valved bottle cap of FIG. 2 mounted onto the neck of a water bottle.
Figure 10:
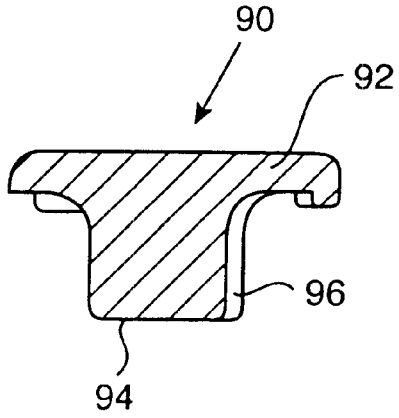
FIG. 10 is an enlarged vertical sectional view taken generally on the line 10—10 of FIG. 4.

As shown in the exemplary drawings, an improved mounting adapter referred to generally by the reference numeral 10 in FIGS. 2–7 is provided for quick and easy, substantially snap-fit removable installation onto the reservoir 12 of a bottled water cooler 14 (FIGS. 1 and 2). The mounting adapter 10 generally comprises a compact adapter body or shell 16 having a relatively simple and preferably unitized plastic molded construction. The adapter body 16 includes a central upstanding tubular post 18 having a feed tube insert 20 removably snap-fit mounted therein and cooperating therewith to define a multi-passage feed tube 22 for engaging and opening a valved bottle cap 24 (FIGS. 2 and 11) mounted on the neck 26 of a water-containing bottle 28.

The improved mounting adapter 10 of the present invention is designed for use with a bottled water cooler 14 of the type having an upwardly open reservoir 12 for receiving and storing a supply of water for ready dispensing upon operation of one or more faucet valves or the like. In this regard, the water cooler 14 is shown generally in FIGS. 1 and 2 and typically comprises a cooler housing or cabinet 30 with the reservoir 12 (FIG. 2) mounted within an upper region thereof and defining an upper end exposed through a cabinet top or lid 32. A water bottle 28 of typically five gallon capacity is mounted onto the cooler 14 in an inverted orientation at the top of the cabinet 30 so that water within the bottle 28 can flow downwardly into and fill the underlying reservoir 12. In one typical water cooler design, the reservoir 12 is designed for removable mounting within the cabinet 30 and the interior of the reservoir 12 is subdivided (FIG. 6) by an internal baffle plate 13 into an upper chamber 12*a* for containing water substantially at room temperature, and a lower chamber 12*b* in thermal association with a chiller probe which may slide-fit into a downwardly open chiller sleeve 15 formed in a bottom wall of the reservoir 12. Separate faucet valves 34 and 36 are mounted on the face of the cooler cabinet 30 (FIGS. 1 and 2) for separately dispensing water from these different-temperature compartments 12*a* and 12*b*. In this regard, the general construction and operation of the illustrative bottled water cooler 14 is described in more detail in U.S. Pat. Nos. 5,246,141; 5,307,958; 5,289,951; 5,395,014; 5,297,700; and 6,167,921 which are incorporated by reference herein.

Figure 12:
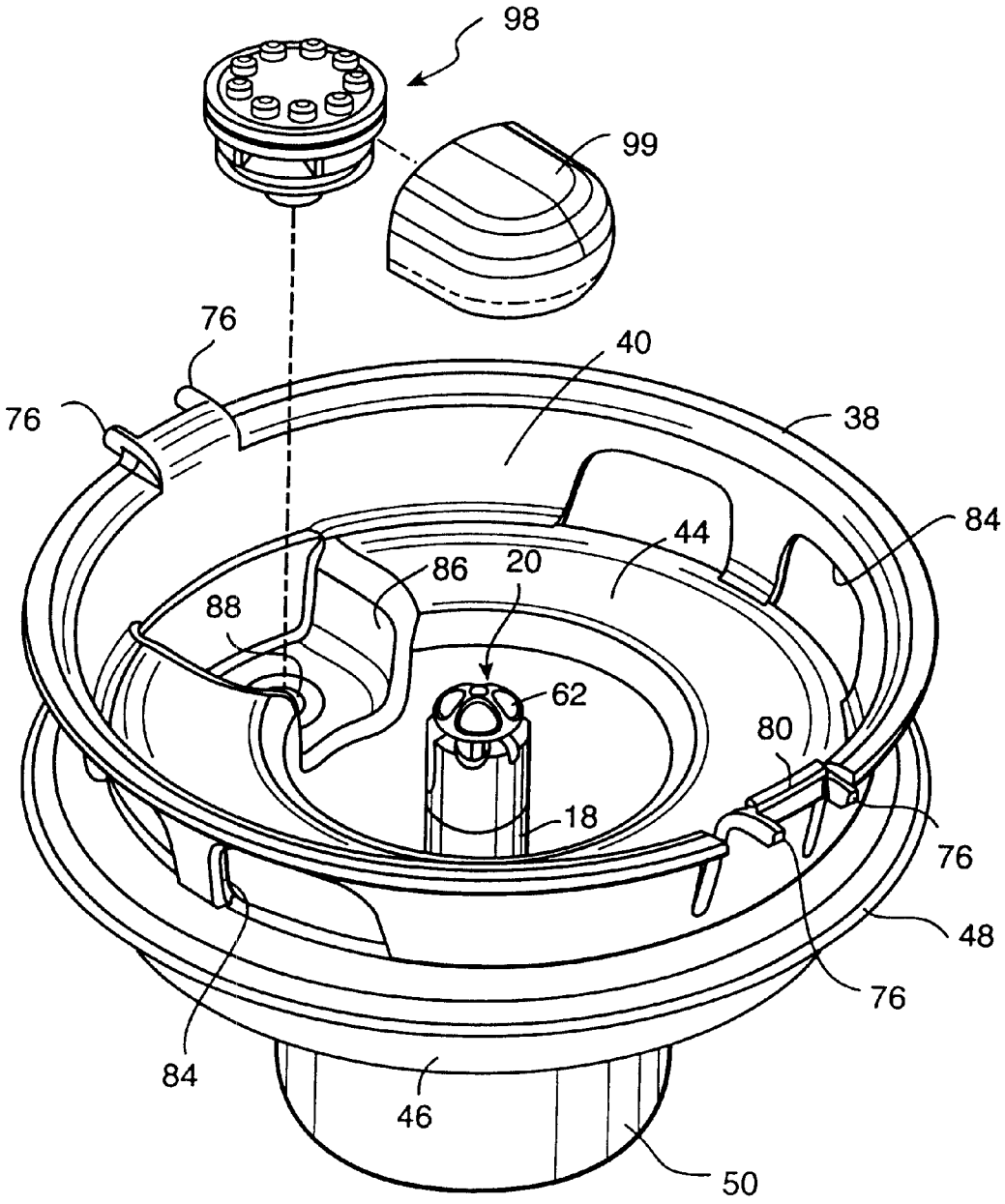
FIG. 12 is a top perspective view of the mounting adapter similar to FIG. 3, but showing the adapter in an alternative configuration for installation into the upper end of a cooler reservoir.

The mounting adapter 10 is shown in one preferred configuration in FIGS. 3–7. As shown, the adapter body or shell 16 is formed as a lightweight plastic molding preferably in a unitized or one-piece geometry. More particularly, this unitized adapter body 16 includes an upper support rim 38 projecting radially outwardly a short distance from the upper margin of a generally cylindrical upper sleeve segment 40, wherein the support rim 38 is sized and shaped to rest upon a radially inwardly extending support ledge 42 (FIG. 3) formed on the reservoir 12 near an upper end thereof. The upper sleeve segment 40 extends downwardly from the support rim 38 to an outer margin of a radially inwardly extending and substantially horizontally oriented annular landing 44. In addition, as viewed best in FIGS. 6 and 7, a peripheral skirt 46 extends downwardly from the juncture of the sleeve segment 40 and the landing 44 to support an optional seal ring gasket 48 (FIG. 12) in an alternative configuration to be described in more detail.

Figure 6:
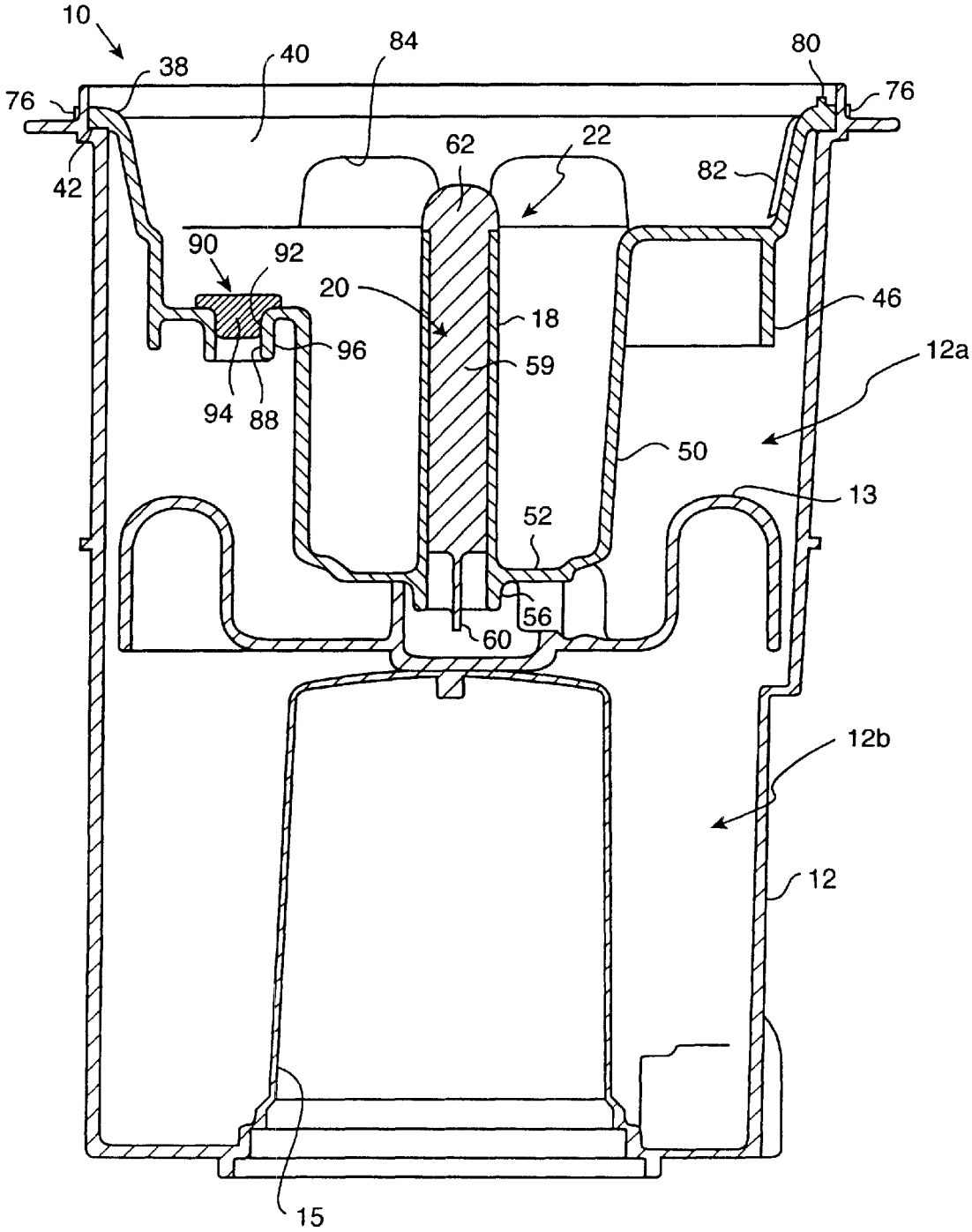
FIG. 6 is an enlarged vertical sectional view taken generally on the line 6—6 of FIG. 5.
Figure 7:
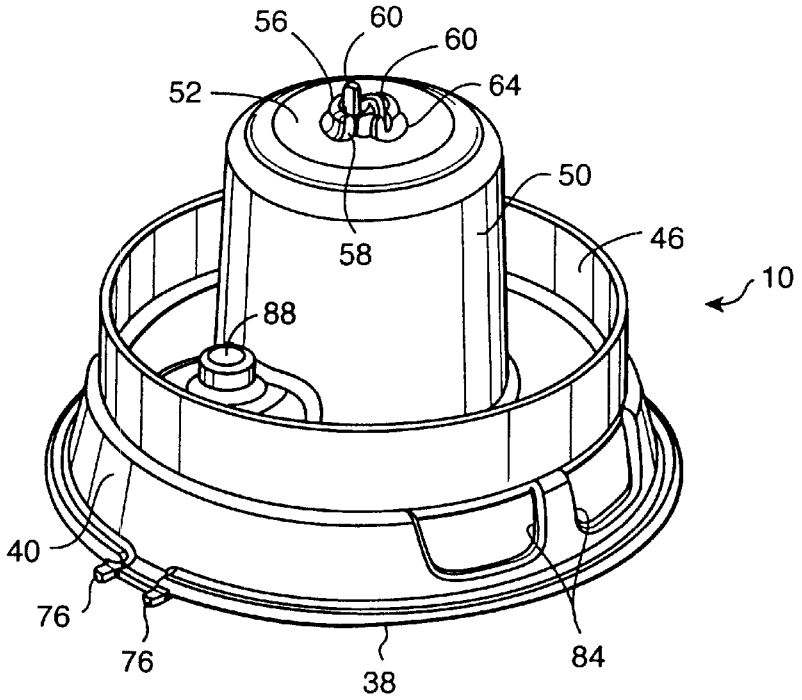
FIG. 7 is a bottom perspective view of the mounting adapter of FIG. 3.
Figure 8:
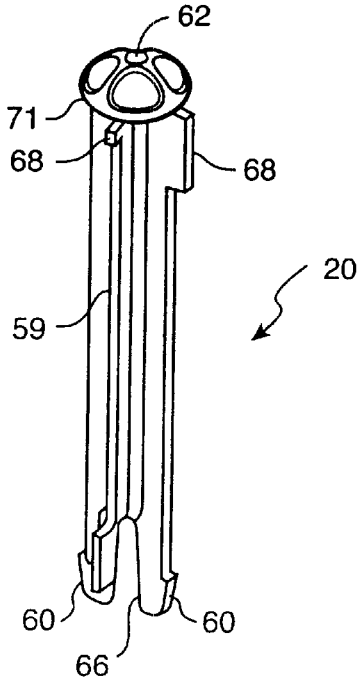
FIG. 8 is an enlarged top perspective view of a feed tube insert for use in the mounting adapter of the present invention.
Figure 9:
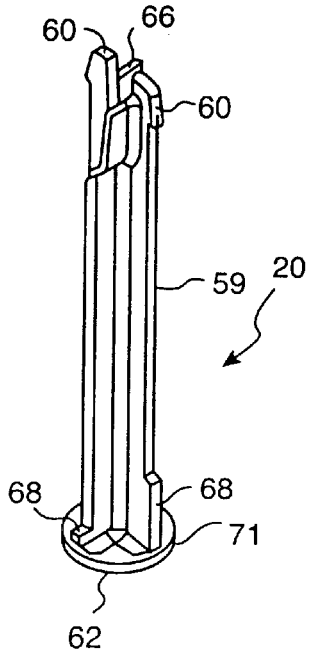
FIG. 9 is an enlarged bottom perspective view of the feed tube insert of FIG. 8.

The radially inner margin of the annular landing 44 merges with a downwardly protruding or suspended central cup or well 50 which in turn has a bottom wall 52 (FIGS. 6 and 7). The tubular post 18 upstands centrally from the bottom wall 52 to define a tubular pathway 54 (FIG. 4) extending from the bottom wall in an upward direction terminating at the upper end of the post 18 at a location a short distance above the plane of the landing 44. As viewed in FIGS. 6–7, a depending annular flange 56 extends downwardly from the underside of the bottom wall 52 a short distance in circumscribing relation to the tubular pathway 54. This arcuately shaped flange 56 is interrupted by at least one notch 58 which extends over an arcuate span of about at least about 90°.

The feed tube insert 20 is provided as a separate component which may also be formed from a suitable lightweight molded plastic material or the like. As shown (FIGS. 4, 6, 8 and 9), the feed tube insert 20 comprises an elongated rod 59 having a generally X-shaped cross section extending between a pair of latch tabs 60 at a lower end thereof to a generally mushroom-shaped tip or head 62 at an upper end thereof. The feed tube insert 20 is configured for press-fit placement downwardly into the open upper end of the central tubular post 18, to displace the latch tabs 60 to a locked position engaged and latched within a corresponding pair of latch recesses 64 formed in the bottom flange 56 (FIG. 7) of the adapter body 16. Importantly, the two latch tabs 50 are spaced apart by an intervening, downwardly open central slot 66 to provide sufficient radial resilience to permit the latch tabs to be squeezed together for lift-out removal of the feed tube insert 20 from the tubular post 18.

The upper end of the feed tube insert 20 incorporates a plurality of relatively short, outwardly radiating ribs 68 having an array of different sizes and shapes for matingly seating into a corresponding plurality of upwardly presented recesses 70 formed in the upper end of the tubular post 18. These recesses 70 thus cooperate with the insert ribs 68 for rotationally orienting the feed tube insert 20 relative to the tubular post 18, and also provide open flow passages for transit of air and water between the overlying water bottle 28 and the underlying cooler reservoir 12, as will be described in more detail. These open flow passages extend downwardly within the tubular post 18, through quarter-circle channels defined by the X-shaped cross section of the rod 59 in cooperation with the interior surface of the tubular post. The arcuate notch or notches 58 formed in the flange 56 at the underside of the bottom wall 52 provides an entry point to at least one of these flow channels at a location vertically higher that the inlet point to the remaining flow channels, wherein each flow channel aligned with a flange notch 58 comprises an air flow channel.

The head 62 of the feed tube insert 20 is configured for engaging and operating a valved bottle cap 24 (FIGS. 2 and 11) on the inverted water bottle 28. More particularly, the head 62 is positioned at the upper end of the central tubular post 18 and defines a perimeter 71 which is slightly undercut for engaging, opening, and retaining a valve plug 72 (shown best in FIG. 11) of the valved bottle cap 24 incident to bottle placement onto the water cooler 14. The head 62 is further designed and sized to release the valve plug 72 while re-seating the valve plug on the body of the valved cap 24 incident to bottle removal from the water cooler 14. The specific geometry of the feed tube head 62 and the associated bottle cap 24 to perform these functions is known in the art as described, for example, in U.S. Pat. No. 5,413,152, which is incorporated by reference herein.

Figure 3:
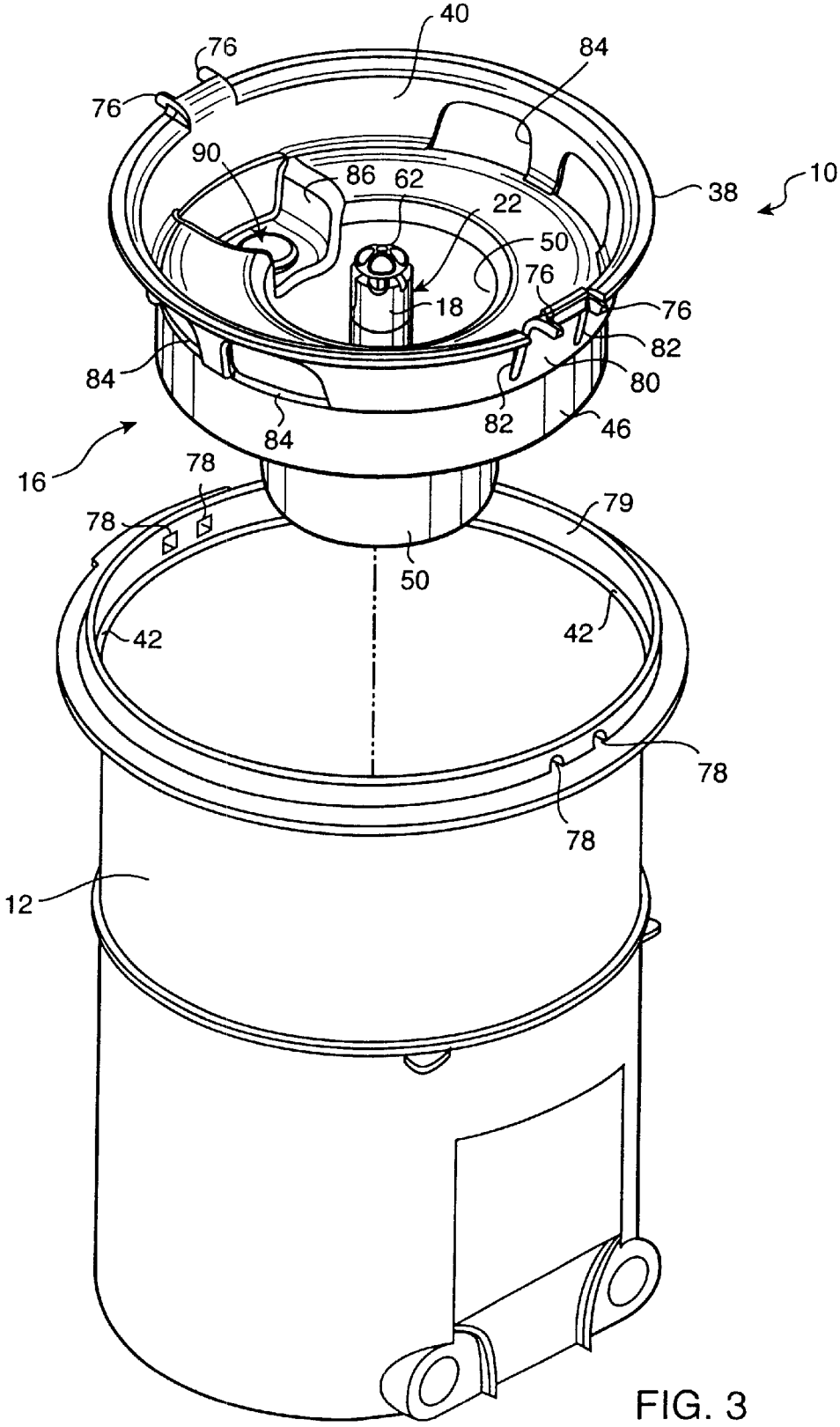
FIG. 3 is an enlarged and exploded top perspective view showing the mounting adapter of the present invention in combination with the removable cooler reservoir.
Figure 4:
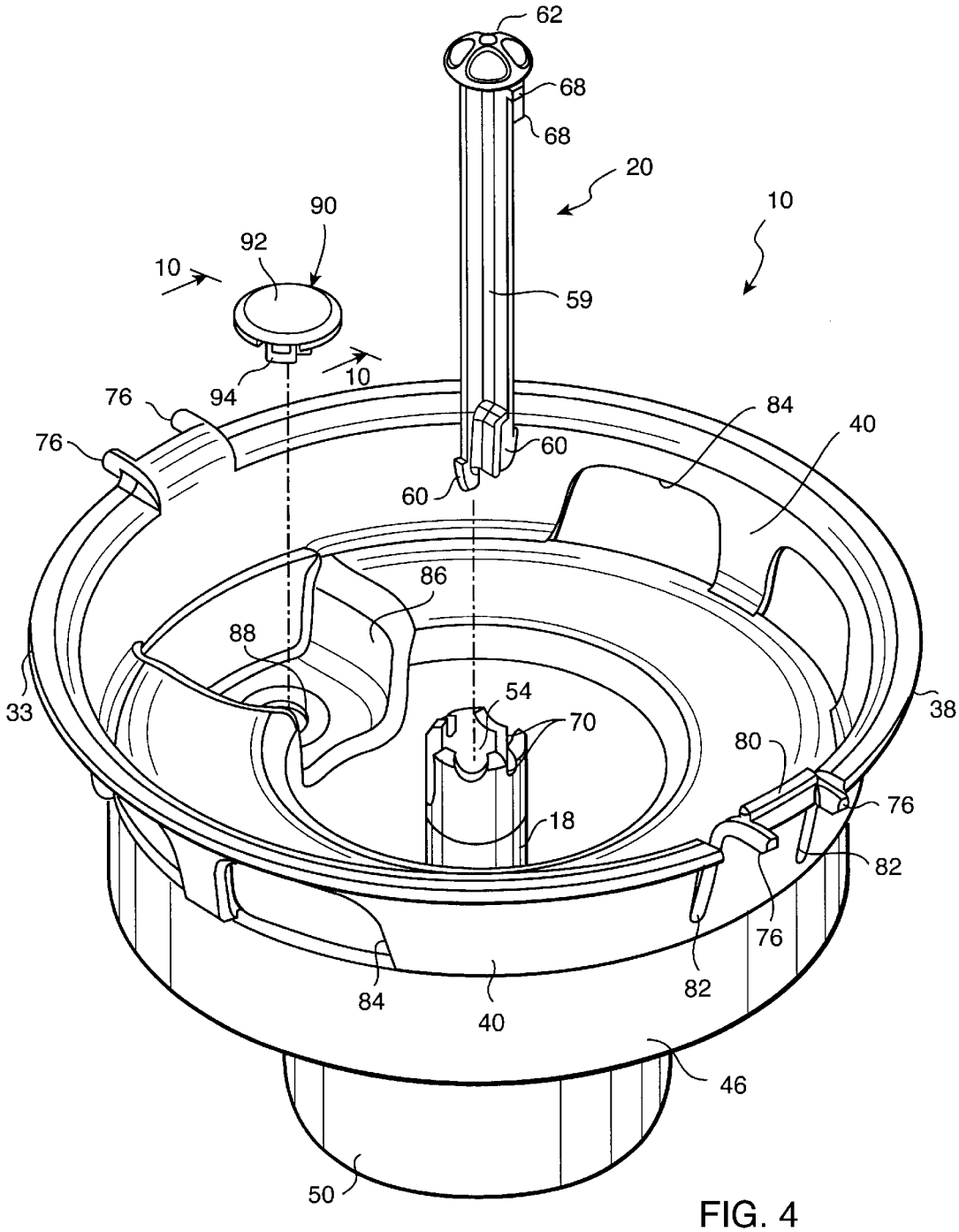
FIG. 4 is an exploded perspective view of the mounting adapter of FIG. 2.
Figure 5:
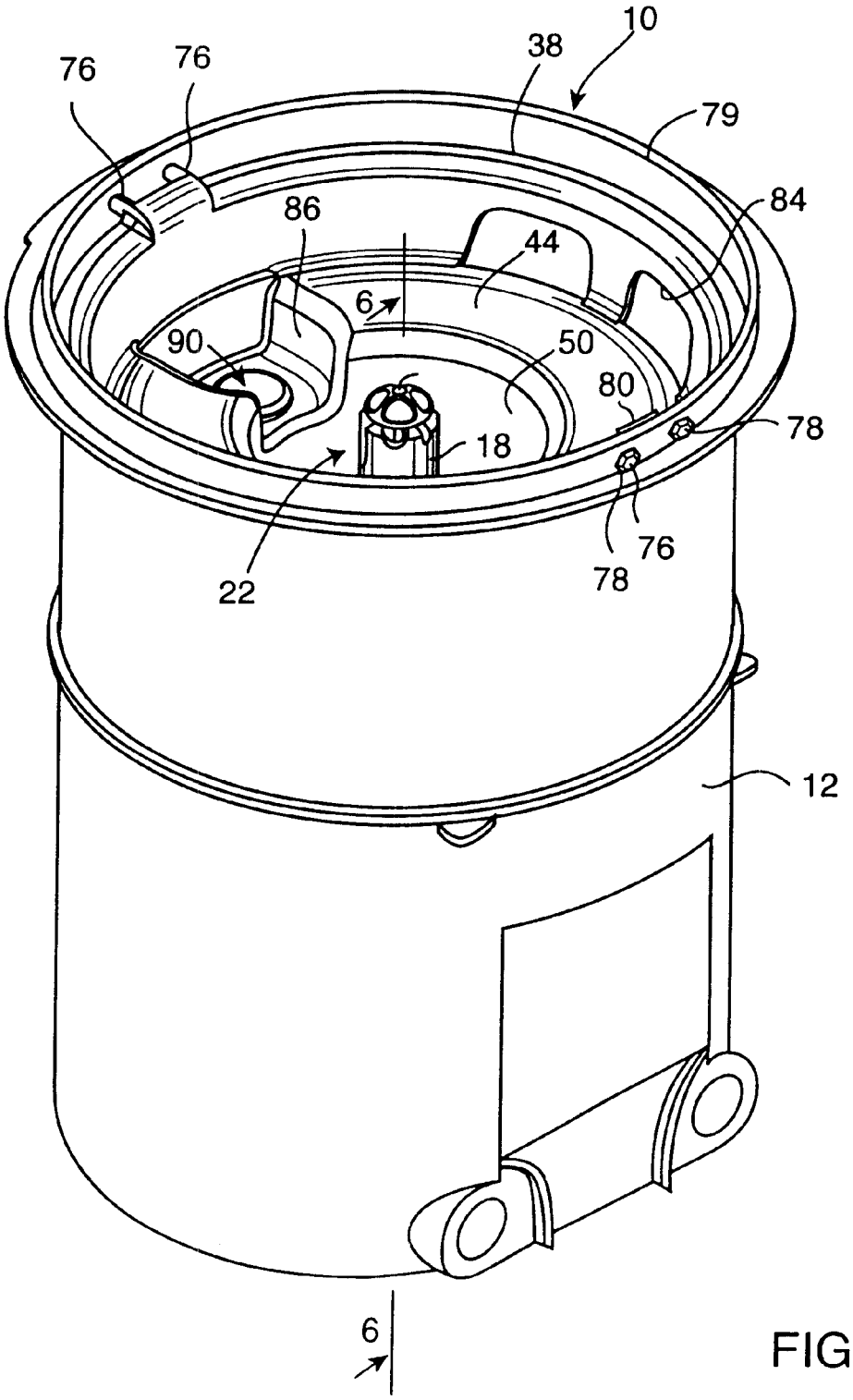
FIG. 5 is a top perspective view similar to FIG. 3, and illustrating the mounting adapter installed into the upper end of the cooler reservoir.

In accordance with a primary aspect of the invention, the adapter 10 includes snap-fit mounting means for quickly and easily securing the adapter body 16 on the cooler reservoir 12 in a stable yet easily removable manner. In the illustrative drawings, the snap-fit mounting means comprises two pairs of generally outwardly projecting detent pins 76 positioned at generally diametrically opposed locations along the upper support rib 38. These pairs of these detent pins 76, which extend generally in parallel to each other, are positioned for snap-fit seating into corresponding pairs of detent ports 78 formed in a short upstanding upper flange 79 of the reservoir, at a position above the support ledge 42. FIG. 3 shows the adapter 10 in exploded relation above the reservoir 12, while FIG. 4 illustrates the installed position of the adapter with the detent pins 76 locked into the aligned detent ports 78 in the reservoir.

The detent pins 76 at one side of the adapter body 16 are carried by a short spring tab 80, separated from the adjoining cylindrical sleeve segment 40 by a pair of upwardly open slots 82. The spring tab 80 can be manually pressed in a radially inward direction relative to the remainder of the sleeve segment 40 to release the associated detent pins 76 from the reservoir, in the event that removal of the adapter 10 from the reservoir is desired, for example, for replacement or cleaning.

The adapter 10 is installed quickly and easily onto the cooler reservoir 12 by simply pressing the adapter support rim 38 onto the support ledge 42 at the reservoir upper end, while aligning the detent pins 76 for snap-fit reception into the detent ports 78. Manual handling of the adapter 10 for installation is facilitated radially open handle ports 84 formed in the cylindrical sleeve segment 42 at the upper end of the adapter. In the mounted position, a water bottle 28 can be installed onto the cooler in an inverted orientation for engagement of the valved bottle cap 24 thereon by the feed tube 22. In particular, the feed tube head 62 engages, opens and retains the cap valve plug 72 as the bottle 28 is mounted onto the reservoir. Water is free to flow downwardly from the inverted water bottle 28 to substantially fill the reservoir 12. During this filling process, water flows downwardly through the flow channels within the feed tube 22, while air is free to exchange upwardly from the reservoir to the bottle interior via the flow channel associated with the flange notch 58. This air-water exchange continues until the reservoir water level rises sufficiently to cover and close the flange notch 58, at which time the downward water flow is halted. Subsequently, upon dispensing of water from the reservoir via operation of either faucet valve 34, 36, the reservoir water level will fall sufficiently to uncover the flange notch 58 and thereby permit upward air flow from the reservoir to the overlying bottle interior. This resumed air flow is accompanied by resumed downward water flow from the bottle to the reservoir until the level again rises sufficiently to halt the air-water exchange, as previously described.

When the bottle 28 is empty, the bottle can be removed from the cooler 14 by simple lift-off displacement. In the course of such movement, the valve plug 72 captured by the feed tube 22 is re-seated on the bottle cap 24. Thereafter, a fresh filled water bottle can be installed onto the cooler to provide a continued supply of fresh and clean water.

FIGS. 3–7 illustrate the adapter 10 of the present invention in a so-called "unsealed" configuration wherein the cooler reservoir 12 is substantially open to ambient air when the adapter is mounted thereon. In this configuration, the adapter 10 facilitates bottle mounting and removal substantially without risk of spilling water, and further functions to prevent large or sizable dirt and other debris from falling directly into the otherwise open upper end of the reservoir. A recessed pocket 86 formed in the landing 44 includes an air inflow port 88 for insuring such ingress of ambient air into the reservoir, with the inflow port 88 being occluded but not sealed by a plug 90 (shown best in FIGS. 4, 6 and 9) having an enlarged cap 92 over a plug stem 94 having an air flow groove 96 formed therein. The stem 94 is desirably sized and shaped for snap-fit mounting into the inflow port 88.

In an alternative and so-called "sealed" configuration (viewed in FIG. 12), the adapter may be equipped with the seal ring gasket 48 carried about the skirt 46 at the lower end of the sleeve segment 40. The seal ring gasket 48 is sized for sealingly engaging the interior wall surface of the cooler reservoir 12 at a location below the upper support ledge 42. When the gasket 48 is used, the plug member 90 (FIGS. 3–6 is removed from the air inflow port 88 and replaced by an air filter unit 98 (FIG. 12) of the type shown and described in U.S. Pat. No. 6,167,921, which is incorporated by reference herein. This air filter unit 98 may include a cover shroud 99 designed to snap-fit mount thereon to protect internal filter components against direct exposure to dirt and other debris. The seal ring gasket 48 and the air filter unit 98 effectively seal the reservoir interior with respect to ambient air, and air inflow from the outside into the reservoir is confined to passage of filtered air through the air filter unit. Accordingly, in this version, the adapter assembly additionally prevents entry of small or microscopic air-borne contaminants into the reservoir interior.

In either configuration, the adapter 10 is removable quickly and easily from the cooler reservoir 12 by simple release of the snap-fit mounting means. More particularly, the spring tab 80 can be manually pressed radially inwardly to release the associated detent pins 76 from the aligned detent ports 78 on the reservoir, whereupon the adapter 10 can be lifted upwardly therefrom. Once again, such manipulation of the adapter is facilitated by the handle ports 84 formed therein. When removed from the reservoir 12, the adapter 10 can be subjected to appropriate maintenance procedures such as cleaning. If desired, the feed tube insert 20 can also be removed from the central tubular post 18 by pressing the latch tabs 60 radially toward each other sufficiently to release the latch tabs from the flange recesses 64 and permit upward slide-out removal of the insert 20 from the adapter body 16. Following cleaning or other selected maintenance, the feed tube insert 20 can be re-assembled with the adapter body 16, followed by quick and easy re-assembly of the adapter 10 onto the top of the cooler reservoir 12.

A variety of modifications and improvements in and to the feed tube adapter 10 of the present invention will be apparent to those persons skilled in the art. For example, while a particular snap-fit means has been shown and described for snap-fit mounting the adapter 10 onto the cooler reservoir 12, and for snap-fit mounting the feed tube insert 20 into the tubular central post 18, it will be recognized and appreciated that alternative and equivalent snap-fit and desirably quick-release interfitting components may be utilized.

Accordingly, no limitation on the invention is intended by way of the foregoing description and accompanying drawings, except as set forth in the appended claims.

What is claimed is:

1. In a feed tube adapter having an adapter body for mounting generally over an upper end of an upwardly open water reservoir of a bottled water cooler, and an upstanding feed tube for engaging and opening a bottle cap carried on the neck of a water bottle installed onto the bottled water cooler in an inverted orientation, the improvement comprising:

snap-fit mounting means for removably securing said adapter body onto said reservoir;

said snap-fit mounting means including at least one radially outwardly projecting detent pin formed on said adapter body for releasible snap-fit reception into at least one corresponding detent port formed in said reservoir generally at said upper end thereof.

2. The improvement of claim 1 wherein said at least one detent pin comprises a plurality of generally radially outwardly projecting detent pins formed on said adapter body, and wherein said at least one detent port comprises a plurality of detent ports formed in said reservoir for releasible and respective snap-fit reception of said detent pins.

3. The improvement of claim 2 wherein said detent pins are formed on said adapter body generally at diametrically opposed positions at an upper end thereof, and further wherein said detent ports are formed in said reservoir generally at diametrically opposed positions thereon.

4. The improvement of claim 3 wherein at least one of said detent pins is formed on a spring tab carried by said adapter body.

5. The improvement of claim 2 wherein said adapter body includes a radially outwardly projecting support rim formed generally at an upper end thereof, and further wherein said reservoir includes a support ledge formed generally at said upper end thereof for seated support of said adapter body support rim.

6. The improvement of claim 5 wherein said reservoir further includes a flange extending upwardly from said support ledge, said detent pins projecting radially outwardly from said adapter body support rim for releasible snap-fit reception respectively into said detent ports formed in said reservoir flange.

7. The improvement of claim 1 wherein said snap-fit mounting means comprises first and second pairs of radially outwardly projecting detent pins formed on said adapter body generally at diametrically opposed positions and generally at an upper end thereof for releasible snap-fit reception respectively into first and second pairs of detent ports formed in said reservoir generally at diametrically opposed positions and generally at said upper end thereof.

8. The improvement of claim 7 said first pair of detent pins is formed on a spring tab carried by said adapter body.

9. The improvement of claim 1 wherein said adapter body comprises a generally cylindrical upright sleeve segment, a radially outwardly projecting support rim formed generally at an upper end of said sleeve segment, a generally annular landing extending generally radially inwardly from a lower end of said sleeve segment, a generally cup-shaped well suspended from a radially inner margin of said landing and defining a bottom wall, and a tubular feed tube post upstanding centrally from said bottom wall within said cup-shaped well.

10. The improvement of claim 9 wherein said adapter body comprises a unitary plastic molding.

11. The improvement of claim 9 including means carried at an upper end of said feed tube post for engaging and opening a bottle cap carried on the neck of a water bottle.

12. The improvement of claim 11 wherein said means carried by said feed tube post for engaging and opening a bottle cap comprises a feed tube insert including means for snap-fit mounting within said feed tube post and further including a contoured head for engaging and opening a bottle cap.

13. The improvement of claim 12 wherein said feed tube insert comprises an elongated rod having a size and shape for slide-fit reception into said feed tube post, and at least one latch tab carried at a lower end of said rod for snap-fit engagement with a lower end of said feed tube post, said contoured head being carried at an upper end of said rod.

14. The improvement of claim 13 wherein said contoured head at the upper end of said rod is disposed at least slightly above said landing.

15. The improvement of claim 13 wherein said rod is shaped to subdivide the interior of said feed tube post into at least one water flow passage and at least one air flow passage.

16. The improvement of claim 15 wherein said feed tube post further defines at least one recessed notch formed generally at a lower end of said at least one air flow passage whereby the lower end of said at least one air flow passage is disposed at least slightly above a lower end of said at least one water flow passage.

17. The improvement of claim 16 further including means for aligning said feed tube insert in a predetermined rotational orientation relative to said feed tube post.

18. The improvement of claim 13 wherein said rod has a generally X-shaped cross section.

19. The improvement of claim 13 wherein said upper end of said feed tube post and said contoured head cooperatively define passage means for water flow downwardly through said feed tube post and for air flow upwardly through said feed tube post.

20. The improvement of claim 9 further including a peripheral skirt depending generally from a lower end of said sleeve segment, and a seal ring gasket carried by said skirt for sealingly engaging said reservoir, said adapter body defining an air inflow port for intake of ambient air into said reservoir, and further including an air filter mounted over said air inflow port.

21. The improvement of claim 1 further including a seal ring gasket carried by said adapter body for sealingly engaging said reservoir, said adapter body defining an air inflow port for intake of ambient air into said reservoir, and further including an air filter mounted over said air inflow port.

22. The improvement of claim 1 wherein said adapter body defines an air inflow port for intake of ambient air into said reservoir, and further including means mounted over said air inflow port for occluding entry of debris into said reservoir.

23. The improvement of claim 22 wherein said occluding means comprises a plug including a slotted stem received into said air inflow port, and a radially enlarged plug cap at an upper end of said slotted stem.

24. A bottled water dispensing system, comprising:

a water cooler housing having an upwardly open water reservoir mounted thereon; and a feed tube adapter having an adapter body for mounting generally over an upper end of said reservoir, and an upstanding feed tube for engaging and opening a bottle cap carried on the neck of a water bottle installed onto said cooler housing in an inverted orientation, said feed tube adapter and said reservoir including interengageable snap-fit mounting means for removably securing said adapter body onto said reservoir;

said snap-fit mounting means comprising a plurality of generally radially outwardly projecting detent pins formed on said adapter body generally at diametrically opposed positions and generally at an upper end thereof for releasible snap-fit reception respectively into a plurality of detent ports formed in said reservoir generally at diametrically opposed positions and generally at said upper end thereof.

25. The bottled water dispensing system of claim 24 wherein said detent pins comprise first and second pairs of radially outwardly projecting detent pins formed on said adapter body generally at generally diametrically opposed positions, and further wherein said detent ports comprise first and second pairs of detent ports formed in said reservoir generally at diametrically opposed positions.

26. The bottled water dispensing system of claim 25 said first pair of detent pins is formed on a spring tab carried by said adapter body.

27. The bottled water dispensing system of claim 26 wherein said adapter body includes a radially outwardly projecting support rim formed generally at an upper end thereof, and further wherein said reservoir includes a support ledge formed generally at said upper end thereof for seated support of said adapter body support rim, said spring tab being formed as a portion of said support rim.

28. The bottled water dispensing system of claim 27 wherein said reservoir further includes a flange extending upwardly from said support ledge, said detent pins projecting radially outwardly from said adapter body support rim for releasible snap-fit reception respectively into said detent ports formed in said reservoir flange.

29. The bottled water dispensing system of claim 24 wherein said adapter body comprises a generally cylindrical upright sleeve segment, a radially outwardly projecting support rim formed generally at an upper end of said sleeve segment, a generally annular landing extending generally radially inwardly from a lower end of said sleeve segment, a generally cup-shaped well suspended from a radially inner margin of said landing and defining a bottom wall, and a tubular feed tube post upstanding centrally from said bottom wall within said cup-shaped well.

30. The bottled water dispensing system of claim 29 wherein said adapter body comprises a unitary plastic molding.

31. The bottled water dispensing system of claim 29 further including a feed tube insert including means for snap-fit mounting within said feed tube post and having including a contoured head for engaging and opening a bottle cap.

32. The bottled water dispensing system of claim 31 wherein said feed tube insert comprises an elongated rod having a size and shape for slide-fit reception into said feed tube post, and at least one latch tab carried at a lower end of said rod for snap-fit engagement with a lower end of said feed tube post, said contoured head being carried at an upper end of said rod.

33. The bottled water dispensing system of claim 32 wherein said contoured head at the upper end of said rod is disposed at a position at least slightly above said landing.

34. The bottled water dispensing system of claim 32 wherein said rod is shaped to subdivide the interior of said feed tube post into at least one water flow passage and at least one air flow passage.

35. The bottled water dispensing system of claim 34 wherein said feed tube post further defines at least one recessed notch formed generally at a lower end of said at least one air flow passage whereby the lower end of said at least one air flow passage is disposed at least slightly above a lower end of said at least one water flow passage.

36. The bottled water dispensing system of claim 29 further including a peripheral skirt depending generally from a lower end of said sleeve segment, and a seal ring gasket carried by said skirt for sealingly engaging said reservoir, said adapter body defining an air inflow port for intake of ambient air into said reservoir, and further including an air filter mounted over said air inflow port.

37. The bottled water dispensing system of claim 24 further including a seal ring gasket carried by said adapter body for sealingly engaging said reservoir, said adapter body defining an air inflow port for intake of ambient air into said reservoir, and further including an air filter mounted over said air inflow port.

38. The bottled water dispensing system of claim 24 wherein said adapter body defines an air inflow port for intake of ambient air into said reservoir, and further including means mounted over said air inflow port for occluding entry of debris into said reservoir.

39. The bottled water dispensing system of claim 38 wherein said occluding means comprises a plug including a slotted stem received into said air inflow port, and a radially enlarged plug cap at an upper end of said slotted stem.

40. A bottled water dispensing system, comprising:

a water cooler housing having an upwardly open water reservoir mounted thereon; and a feed tube adapter having an adapter body for mounting generally over an upper end of said reservoir, and an upstanding feed tube for engaging and opening a bottle cap carried on the neck of a water bottle installed onto said cooler housing in an inverted orientation, said feed tube adapter and said reservoir including interengageable mounting means for removably securing said adapter body onto said reservoir;

said adapter body comprising a unitary plastic molding including a generally cylindrical upright sleeve segment, a radially outwardly projecting support rim formed generally at an upper end of said sleeve segment, a generally annular landing extending generally radially inwardly from a lower end of said sleeve segment, a generally cup-shaped well suspended from a radially inner margin of said landing and defining a bottom wall, and a tubular feed tube post upstanding centrally from said bottom wall within said cup-shaped well;

said feed tube comprising said feed tube post, and a feed tube insert including means for mounting on said feed tube and further including a contoured head for engaging and opening a bottle cap, said contoured head of said feed tube insert having an upper end generally at a position at least slightly above said landing;

said feed tube insert comprising an elongated rod having a size and shape for slide-fit reception into said feed tube post, and at least one latch tab carried at a lower end of said rod for snap-fit engagement with a lower end of said feed tube post, said contoured head being carried at an upper end of said rod.

41. The bottled water dispensing system of claim 40 wherein said interengageable mounting means comprises snap-fit mounting means.

42. The bottled water dispensing system of claim 40 wherein said reservoir includes a support ledge formed generally at said upper end thereof for seated support of said adapter body support rim.

43. The bottled water dispensing system of claim 40 wherein said rod is shaped to subdivide the interior of said feed tube post into at least one water flow passage and at least one air flow passage.

44. The bottled water dispensing system of claim 43 wherein said feed tube post further defines at least one recessed notch formed generally at a lower end of said at least one air flow passage whereby the lower end of said at least one air flow passage is disposed at least slightly above a lower end of said at least one water flow passage.

45. The bottled water dispensing system of claim 44 further including means for aligning said feed tube insert in a predetermined rotational orientation relative to said feed tube post.

46. The bottled water dispensing system of claim 40 wherein said rod has a generally X-shaped cross section.

47. The bottled water dispensing system of claim 40 wherein said upper end of said feed tube post and said contoured head cooperatively define passage means for water flow downwardly through said feed tube post and for air flow upwardly through said feed tube post.

48. The bottled water dispensing system of claim 40 further including a seal ring gasket carried by said adapter body for sealingly engaging said reservoir, said adapter body defining an air inflow port for intake of ambient air into said reservoir, and further including an air filter mounted over said air inflow port.

49. The bottled water dispensing system of claim 40 further including a peripheral skirt depending generally from a lower end of said sleeve segment, and a seal ring gasket carried by said skirt for sealingly engaging said reservoir, said adapter body defining an air inflow port for intake of ambient air into said reservoir, and further including an air filter mounted over said air inflow port.

50. The bottled water dispensing system of claim 40 wherein said adapter body defines an air inflow port for intake of ambient air into said reservoir, and further including means mounted over said air inflow port for occluding entry of debris into said reservoir.

51. The bottled water dispensing system of claim 50 wherein said occluding means comprises a plug including a slotted stem received into said air inflow port, and a radially enlarged plug cap at an upper end of said slotted stem.

52. The bottled water dispensing system of claim 50 wherein said air inflow port is formed in a recessed pocket formed in said landing.

* * * * *